US006094119A

United States Patent [19]

Reznik et al.

[11] Patent Number: 6,094,119

[45] Date of Patent: Jul. 25, 2000

[54] PERMANENT MAGNET APPARATUS FOR MAGNETIZING MULTIPOLE MAGNETS

[75] Inventors: Svetlana Reznik, Rochester; Edward P. Furlani, Lancaster; Gary R. Kenny, Rochester, all of N.Y.

[73] Assignee: Eastman Kodak Company, Rochester, N.Y.

[21] Appl. No.: 09/211,762

[22] Filed: Dec. 15, 1998

[51] Int. Cl.[7] ..... H01F 7/20

[52] U.S. Cl. ..... 335/284; 335/306

[58] Field of Search ..... 335/284, 285, 335/302, 306; 29/607; 81/125

[56] References Cited

U.S. PATENT DOCUMENTS

| | | | |
|---|---|---|---|
| 4,103,266 | 7/1978 | Schwartz | 335/289 |
| 4,283,698 | 8/1981 | Fujisawa | 335/306 |
| 4,470,031 | 9/1984 | Steingroever et al. | 335/284 |
| 4,638,280 | 1/1987 | Steingroever et al. | 335/284 |
| 5,063,367 | 11/1991 | Lee | 335/284 |
| 5,659,280 | 8/1997 | Lee et al. | 335/284 |
| 5,666,097 | 9/1997 | Leupold | 335/302 |
| 5,691,682 | 11/1997 | Jeffers et al. | 335/302 |
| 5,724,873 | 3/1998 | Hillinger | 81/451 |
| 5,861,789 | 1/1999 | Bundy et al. | 335/285 |

OTHER PUBLICATIONS

Japanese Publication 7918E95—*KANF—95–235070/31—*JP7142274–A (No Date).

*Primary Examiner*—Lincoln Donovan
*Assistant Examiner*—Tuyen Nguyen
*Attorney, Agent, or Firm*—David M. Woods

[57] ABSTRACT

An apparatus for magnetizing one or more elements having a predetermined outer surface shape, the apparatus comprises one or more permanent magnets having a cavity therethrough which cavity includes a shape conforming substantially to the shape of the outer surface of the one or more elements. The magnets also create a magnetic field that passes into the cavity. The one or more elements are disposed on a support operator for magnetization so that the one or more elements are magnetized when inserted into the cavity.

8 Claims, 5 Drawing Sheets

PERMANENT MAGNET APPARATUS FOR MAGNETIZING MULTIPOLE MAGNETS

FIELD OF THE INVENTION

This invention relates to the fabrication of multipole permanent magnets, and in particular to a permanent magnet apparatus for magnetizing such magnets.

BACKGROUND OF THE INVENTION

Multipole cylindrical permanent magnets are used in numerous applications including magnetic encoders, rotary actuators, magnetic gears, and stepper motors. The mass fabrication of such magnets is a two step process. First, the magnets are formed into the desired shape from bulk unmagnetized permanent magnet material. Second, once the magnets are in the desired shape, they are magnetized. The prior art magnetizers typically comprise a high voltage capacitor bank, a high current switch and a magnetizing fixture. To magnetize the magnet, the capacitor back is charged and the magnet is placed in the magnetizing fixture. Once the capacitor bank is charged to a desired level, the switch is activated discharging the capacitor bank into the magnetizing fixture. Conventional magnetizing fixtures are made by threading standard gauge wire through holes in a block of phenolic or other suitable insulating material. The threading of the wire through the holes is done in a serpentine pattern so as to create the desired pole pattern in the magnet when a current pulse (i.e., 50 to 100 microseconds of high current 10,000 to 50,000 amps) flows through the fixture wires. A significant drawback of these prior art magnetizers is that substantial electrical energy is dissipated in the mass magnetization of magnets. Also, considerable time is required to charge the capacitor bank prior to each magnetization cycle and this limits the magnetization throughput.

SUMMARY OF THE INVENTION

The present invention is directed to overcoming one or more of the problems set forth above. One aspect of the present invention is directed to an apparatus for magnetizing one or more elements having a predetermined outer surface shape, the apparatus comprising: (a) one or more permanent magnets having a cavity therethrough which cavity includes a shape conforming substantially to the shape of the outer surface of the one or more elements, and said magnets create a magnetic field that passes into the cavity; and (b) a support operator to which the one or more elements are disposed for magnetization so that the one or more elements are magnetized when inserted into the cavity.

An advantage of the permanent magnet apparatus of the present invention is that it can magnetize any number of multipole magnets without the need of an external power source which greatly reduces the cost of magnetization as compared to conventional magnetizers.

A further advantage of the present invention is that it can be used for repetitive magnetization of multipole magnets with no time delay between magnetization cycles thereby improving the magnetization throughput as compared to conventional magnetizers.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
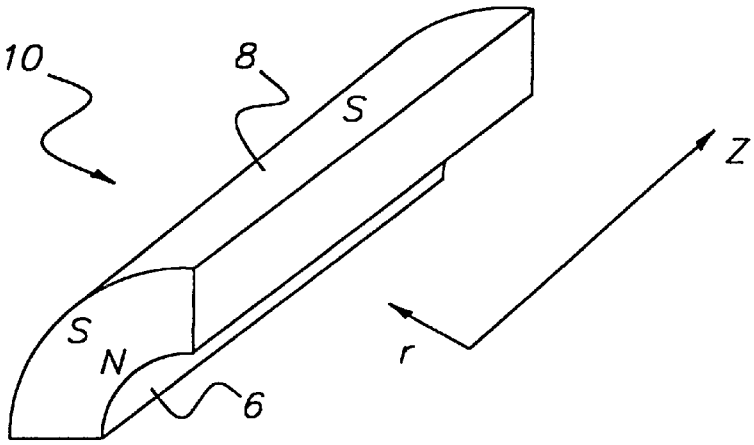
FIG. 1 is a perspective view of a cylindrical sector shaped permanent magnet element of the present invention.

Referring to FIG. 1, a perspective is shown of a permanent magnet element 10. The permanent magnet section 10 is in the shape of a sector of a cylindrical shell, and is polarized along its radial expanse with its inner surface 6 being a north pole and its outer surface 8 being a south pole as shown. Permanent magnet section 10 is fabricated from the high-energy material NdFeB having a magnetic energy product (BH) max of 12 MGOe, and surface field at the center of a pole of up to 3000 Oe.

Figure 2:
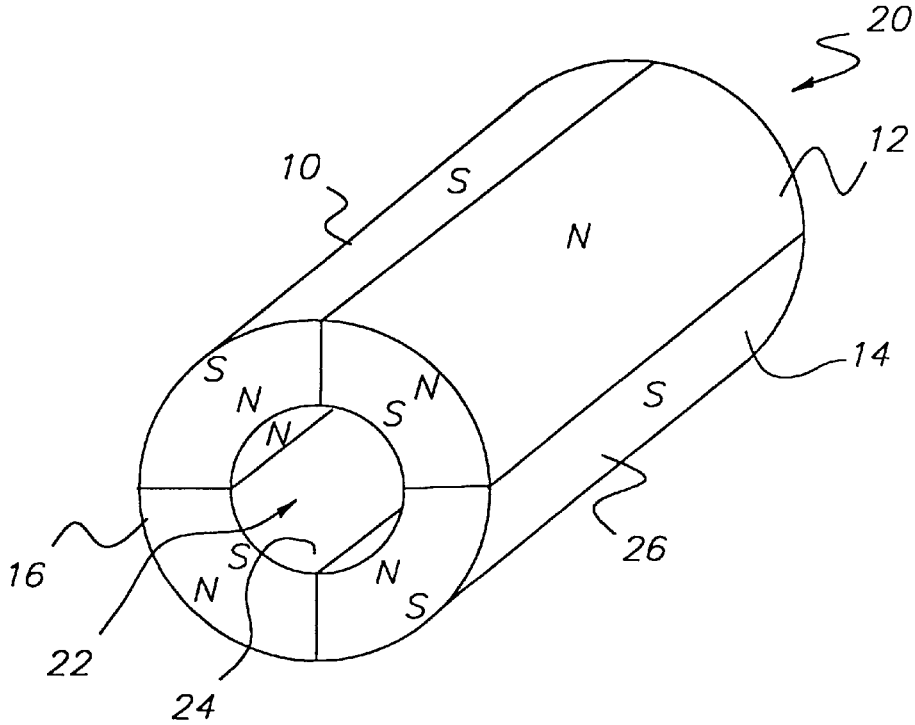
FIG. 2 is a perspective view of a cylindrical, permanent magnet structure of the present invention.

Referring to FIG. 2, a perspective is shown of a permanent magnet structure 20 of the present invention. The permanent magnet structure 20 comprises a plurality of permanent magnet sections 10, 12, 14 and 16, four sections in the present invention. The permanent magnet sections 10, 12, 14 and 16 are arranged so as to form a cavity 22 in permanent magnet structure 20, and the assembled permanent magnet sections include both an inner 24 and outer surface 26. The permanent magnet sections 10, 12, 14 and 16 are polarized such that the inner and outer surfaces 24, 26 of permanent magnet structure 20 have alternating north and south surface poles around their circumference as shown. It is instructive to note that, when the permanent magnet sections 10, 12, 14 and 16 are polarized and arranged in this fashion, the magnet sections 10, 12, 14 and 16 are held together due to their mutual magnetic forces of attraction, as is well known.

Figure 3:
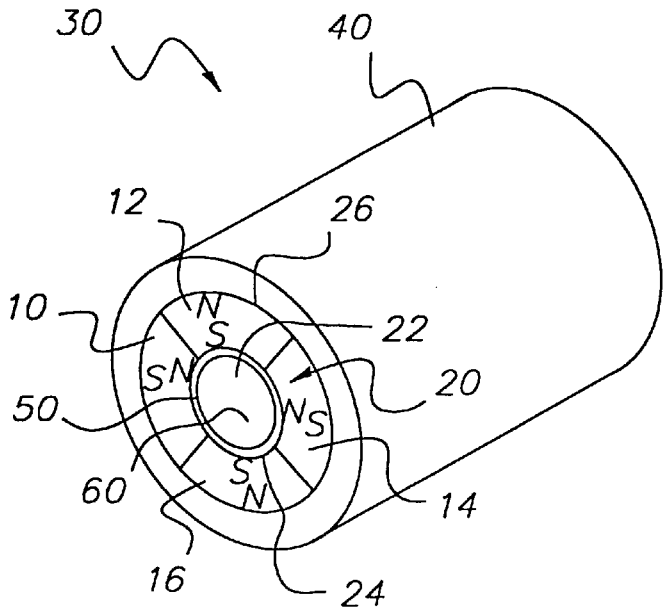
FIG. 3 is a perspective view of the permanent magnet apparatus of the present invention.

Referring to FIG. 3, a perspective view is shown of a permanent magnet apparatus 30 of the present invention. The permanent magnet apparatus 30 includes the permanent magnet structure 20, a ferromagnetic support structure 40, and a bearing element 50. The ferromagnetic support structure 40 surrounds the outer surface 26 of permanent magnet structure 20, and is preferably made from a soft magnetic material including permalloy, supermalloy, sendust, iron, nickel, nickel-iron or alloys thereof. The ferromagnetic support structure 40 provides structural support for the permanent magnet structure 20. The ferromagnetic support structure 40 also acts as a magnetic flux conduit adjoining adjacent surface poles of outer surface 26 of the permanent magnet structure 20, and as such, it enhances the magnetic field in the cavity 22 of the permanent magnet structure 20.

Figure 4:
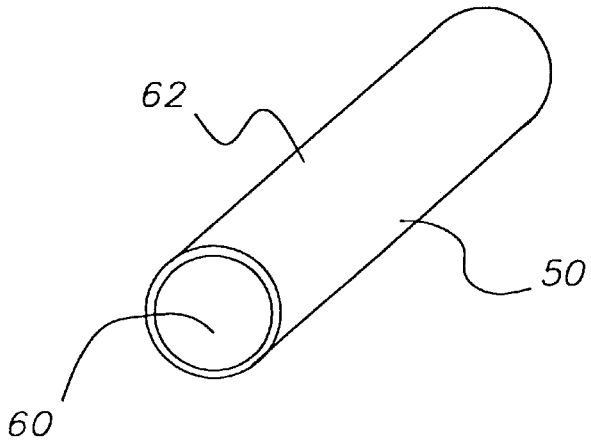
FIG. 4 is a perspective view of a bearing element.

Referring to FIG. 4, the bearing element 50 is in the form of a cylindrical shell with inner surface 60 and outer surface 62. The bearing element 50 is preferably made from low friction porous self-lubricating iron-based sintered material or some films such as Teflon, Delrin or other type of thin-film lubrication, or boundary lubrication could be applied. Before the permanent magnet apparatus is assembled, the outer surface 62 of bearing element 50 is first coated with a thin film of high strength adhesive (epoxy type could be used), and then inserted into the cavity 22 of permanent magnet structure 20, as shown in FIG. 3. Once the adhesive cures, the bearing element 50 is rigidly attached to the inner surface 24 of the permanent magnet structure 20. The bearing element 50 functions as a low-friction surface for supporting magnets as they pass through the inner cavity 22 of the permanent magnet structure 20 while they are being magnetized by the magnetic field of permanent magnet structure 20 as will be described.

Figure 5:
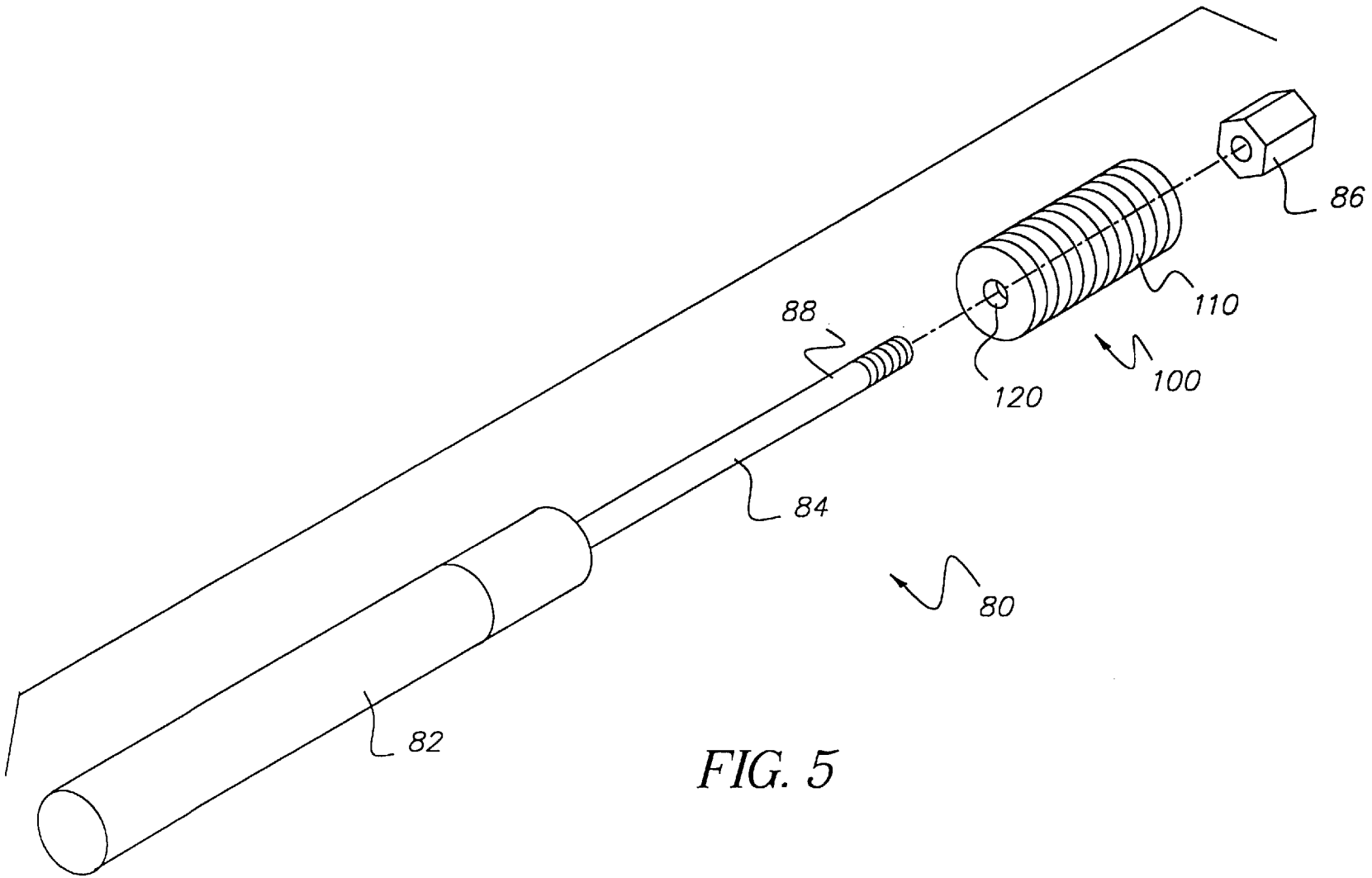
FIG. 5 is a perspective view of a magnet holding member.

Referring to FIG. 5, a perspective view is shown of a magnet holding member 80. The magnet holding member 80 includes a base member 82, a support shaft 84 and a bolt 86. The base member 82 and bolt 86 are made from nonmagnetic materials. The support shaft 84 is preferably made from a soft magnetic material including permalloy, supermalloy, sendust, iron, nickel, nickel-iron or alloys thereof, and has a threaded end 88 for receiving bolt 86. The magnet holding member 80 supports a plurality of magnet elements 100. Each magnet element 110 includes an annular shape with a hole 120 therethrough. The plurality of magnet elements 100 are supported on the support shaft 84 of the magnet holding member 80. Specifically, to support the plurality of magnet elements 100, the support shaft 84 passes through the through hole 120 of each magnet element 110, and then the bolt 86 is screwed onto the threaded end 88 of support shaft 84 thereby holding the plurality of magnet elements 100 in place.

Figure 6A:
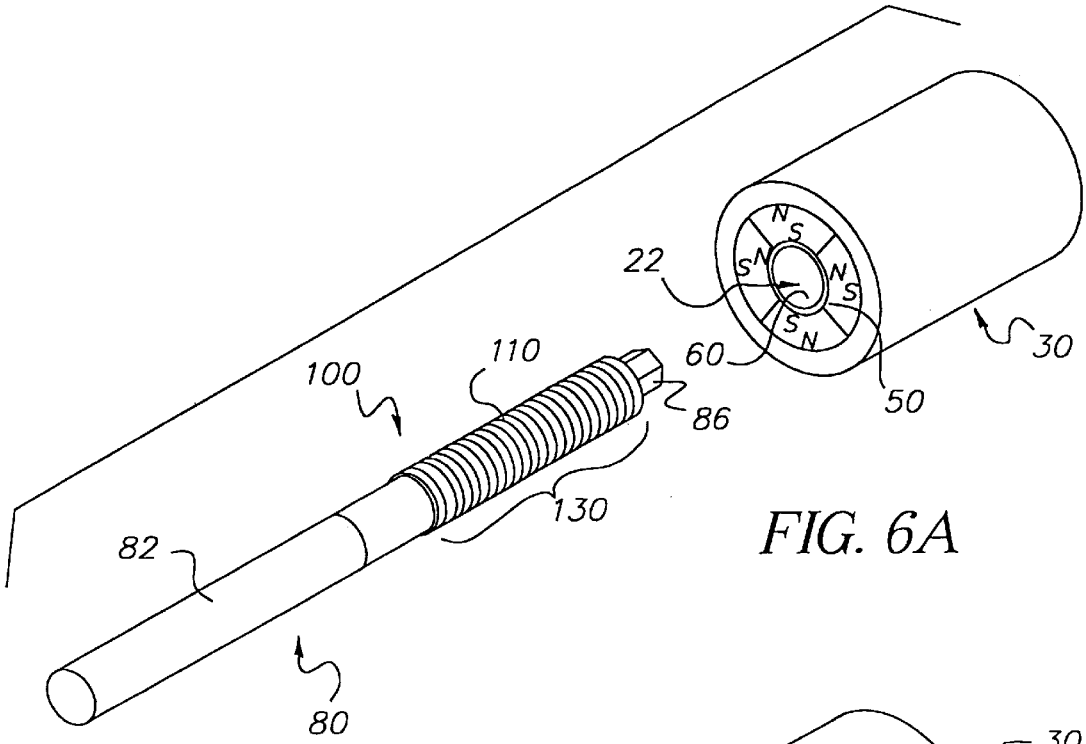
FIGS. 6A, 6B, and 6C illustrate in perspective view the magnetization sequence for magnetizing a plurality of magnet showing the plurality of magnet elements passing through the permanent magnet apparatus of the present invention before, during and after magnetization, respectively; and, FIGS. 7A and 7B show a permanent magnet element before and after magnetization, respectively.
Figure 6B:
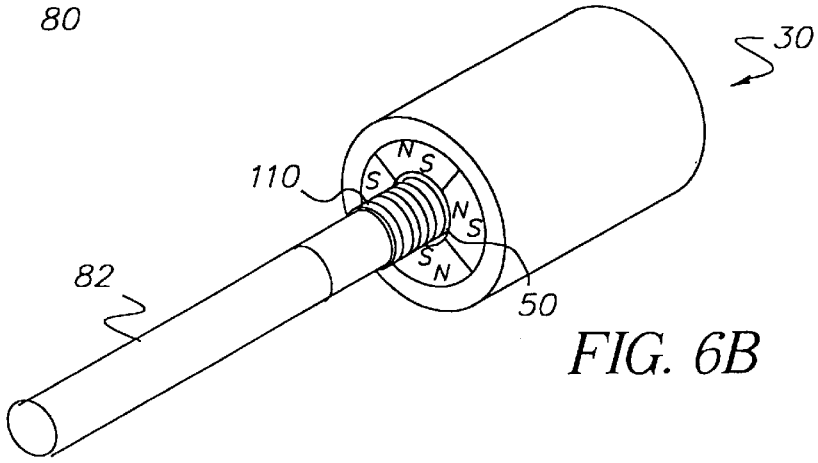
Figure 6C:
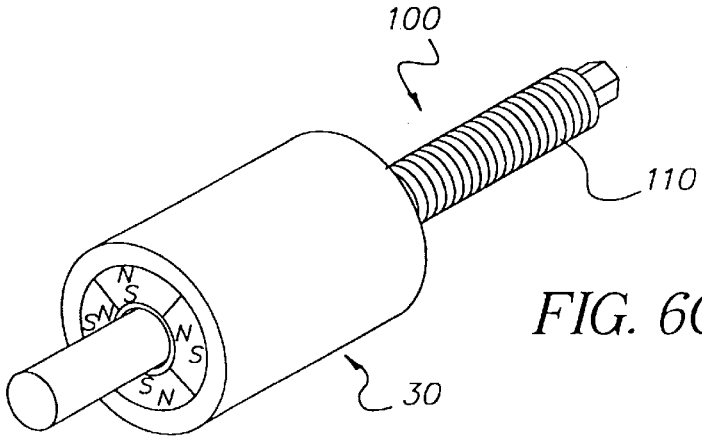

Referring to FIGS. 6A, 6B and 6C, the magnetization sequence for magnetizing the plurality of magnet elements 100 is illustrated in perspective view showing the plurality of magnet elements 100 passing through the cavity 22 of permanent magnet apparatus 30 before, during, and after magnetization, respectively. Initially, each permanent magnet element 110 is unmagnetized (FIG. 7A), and the plurality of permanent magnet elements 100 are mounted on magnet holding member 80 as described above which is in a first position relative to the permanent magnet apparatus 30 as shown in FIG. 6A. To magnetize the plurality of magnet elements 100, the magnet support shaft 84 of magnet holding member 80, with the mounted plurality of magnet elements 100, is inserted into the cavity 22 of permanent magnet apparatus 30. The outer surface 130 of the plurality of magnet elements 100 is in sliding contact with the inner surface 60 of bearing member 50 as the plurality of magnet elements 100 moves through the cavity 22 of permanent magnet apparatus 30. The inner surface 60 of bearing member 50 provides a low friction contact surface thereby facilitating the movement of plurality of magnet elements 100 moves through the cavity 22 of permanent magnet apparatus 30 as shown in FIG. 6B. As each permanent magnet element 110 enters the cavity 22 of permanent magnet apparatus 30, it becomes polarized by the magnetic field inside the cavity 22. This magnetic magnetizing field is caused by the magnet poles around the inner surface 24 of permanent magnet apparatus 30 (see FIG. 2). It is instructive to note that, as each permanent magnet element 110 becomes polarized (see FIG. 7B), the magnetic poles induced on its outer surface align with the poles of opposite polarity around the inner surface 24 of permanent magnet apparatus 30. Thus, each permanent magnet element 110 is precluded from rotating about the support shaft 84 of magnet holding member (see FIG. 5) because of the mutual magnetic force of attraction between the magnetic poles induced on the outer surface of each permanent magnet element 110, and the magnetic poles of opposite polarity around the inner surface 24 of permanent magnet apparatus 30. Also, the ferromagnetic support shaft 84 enhances the penetration of the magnetic magnetizing field into each magnetic element 110 thereby enhancing the magnetization of each magnetic element 110.

Figure 7A:
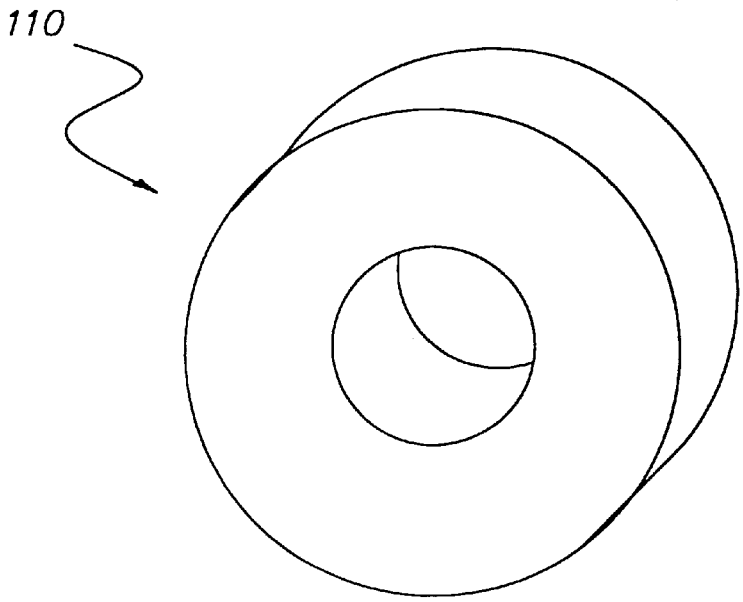
Figure 7B:
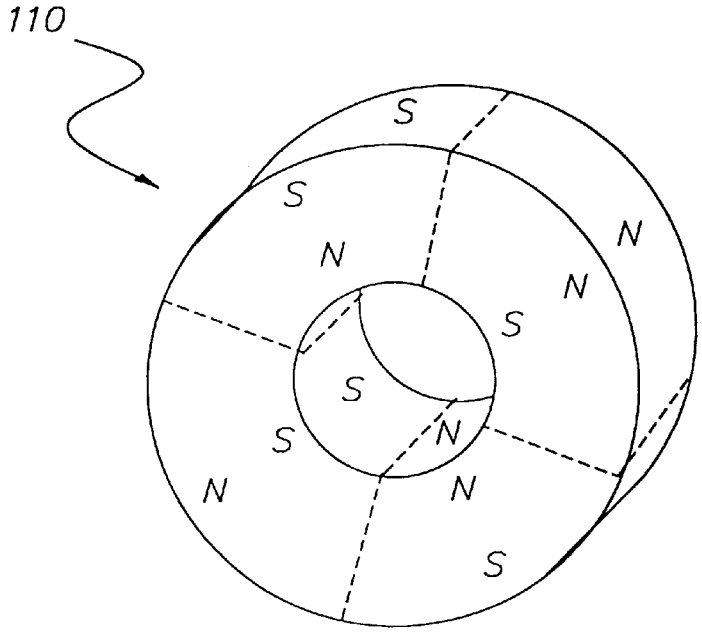

Referring to FIGS. 7A, and 7B, a magnet element 110 is shown in perspective view, before and after magnetization, respectively. Before magnetization, the magnet element 110 comprises a thin cylindrical shell of unmagnetized permanent magnet material. After magnetization, the magnet element 110 has a plurality of radially directed poles of alternating polarity as shown. This pole pattern is induced by the magnetizing field inside the cavity 22 of permanent magnet apparatus 30 as the permanent magnet element passes through the cavity 22 as shown in FIG. 6B.

The invention has been described with reference to a preferred embodiment. However, it will be appreciated that variations and modifications can be effected by a person of ordinary skill in the art without departing from the scope of the invention.

Parts List:

6 inner surface of permanent magnet section
8 outer surface of permanent magnet section
10 permanent magnet section
12 permanent magnet section
14 permanent magnet section
16 permanent magnet section
20 permanent magnet structure
22 cavity
24 inner surface of permanent magnet structure
26 outer surface of permanent magnet structure
30 permanent magnet apparatus
40 ferromagnetic support structure
50 bearing element
60 inner surface of bearing element
62 outer surface of bearing element
80 magnet holding member
82 base member
84 support shaft
86 bolt
88 threaded end
100 plurality of magnet elements
110 magnet element
120 through hole of magnet element
130 outer surface of the plurality of magnet elements

What is claimed is:

1. An apparatus for magnetizing one or more elements having a predetermined outer surface shape, the apparatus comprising:

(a) a plurality of permanent magnets arranged side by side in a cylindrical shell having a cavity therethrough which cavity includes a shape conforming to the shape of the outer surface of the one or more elements, and said permanent magnets create a magnetic field that passes into the cavity; and, (b) a support operator to which the one or more elements are disposed for magnetization so that the one or more elements are magnetized when inserted into the cavity.

2. The apparatus as in claim 1 further comprising a bearing assemblage that forms the cavity, and said permanent magnets are disposed on said bearing assemblage surrounding the cavity.

3. The apparatus as in claim 2 further comprising a structural support positioned for enclosing said permanent magnets.

4. The apparatus as in claim 2 further comprising a bolt, and wherein said operator includes a threaded end for receiving said bolt which assists in maintaining the positional relationship of the one or more elements.

5. A method of magnetizing a plurality of elements having a predetermined outer surface shape, the method comprising the steps of:

(a) providing a plurality of permanent magnets arranged side by side in a cylindrical shell having a cavity therethrough which cavity includes a shape conforming to the shape of the outer surface of the elements, and the permanent magnets create a magnetic field that passes into the cavity; and, (b) inserting a support operator, to which operator the plurality of elements are disposed, into the cavity for magnetizing the elements.

6. The method as in claim 5 further comprising the step of providing a bearing assemblage that forms the cavity, and the permanent magnets are disposed on the bearing assemblage surrounding the cavity.

7. The method as in claim 6 further comprising the step of providing a structural support positioned for enclosing said permanent magnets.

8. The method as in claim 6 further comprising the step of providing a bolt, and wherein the operator includes a threaded end for receiving the bolt which assists in maintaining the positional relationship of the plurality of elements.

* * * * *